United States Patent [19]

Dircksen et al.

[11] 3,938,567

[45] Feb. 17, 1976

[54] TRACTOR MOUNTED LOG SPLITTER

[76] Inventors: Arnold D. Dircksen; David H. Dircksen, both of Rte. 1, Spring Valley, Ohio 45370

[22] Filed: Mar. 29, 1974

[21] Appl. No.: 456,005

[52] U.S. Cl. ..... 144/193 A; 144/193 E; 214/85

[51] Int. Cl.[2] ..... B27L 7/00

[58] Field of Search ..... 144/2 N, 193 R, 193 A, 144/193 D, 193 E; 214/85

[56] References Cited

UNITED STATES PATENTS

| | | | |
|---|---|---|---|
| 2,656,050 | 10/1953 | Best et al. | 214/85 X |
| 2,656,195 | 10/1953 | Martin | 214/85 X |
| 3,077,214 | 2/1963 | Brukner | 144/193 A |
| 3,280,864 | 10/1966 | Spannenberg | 144/193 A |
| 3,319,675 | 5/1967 | Bles, Sr. | 144/193 A |
| 3,760,515 | 9/1973 | Morgan | 144/2 N X |
| 3,760,854 | 9/1973 | Worthington | 144/193 A |
| 3,780,779 | 12/1973 | Guy | 144/193 A |

*Primary Examiner*—Donald R. Schran
*Assistant Examiner*—W. D. Bray
*Attorney, Agent, or Firm*—Phillip L. DeArment

[57] ABSTRACT

The log splitter includes a contilivered I-beam that connects at one end to a three point tractor hitch. An hydraulically activated pusher plate slides along the I-beam to engage one end of a log placed on the beam and drives the log through a wedge-shaped splitting member having two angles of divergent. The tractor supports and adjusts the elevation of the log splitter and provides the fluid drive therefor. A ramp secured to the I-beam assists in loading heavy logs onto the splitting surface and to support the I-beam on the ground.

6 Claims, 4 Drawing Figures

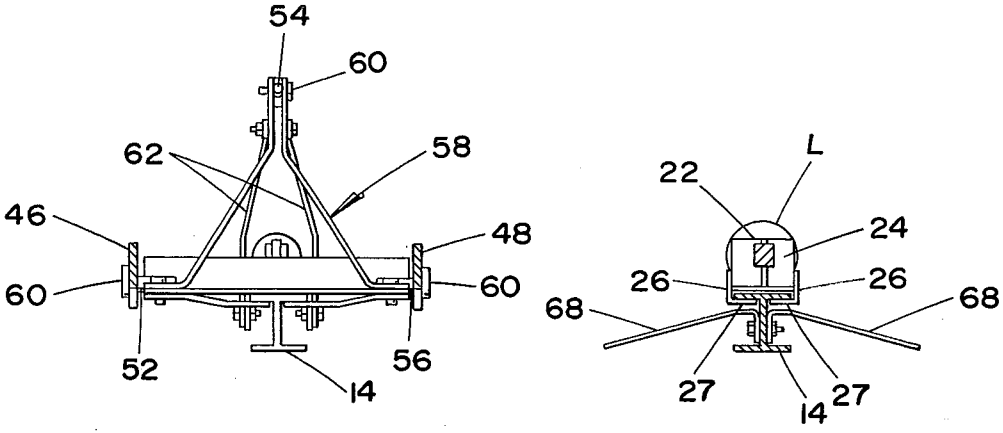
FIG. 3
FIG. 4
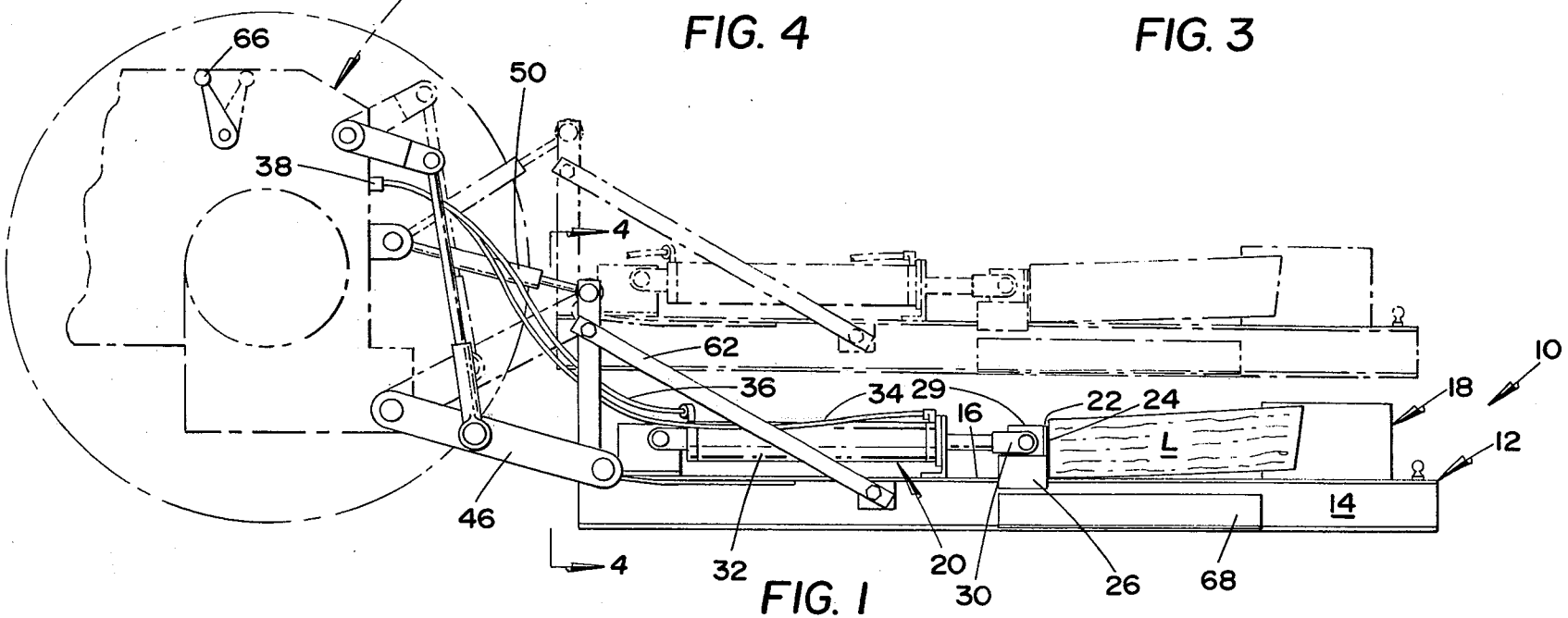
FIG. 1

TRACTOR MOUNTED LOG SPLITTER

BACKGROUND OF THE INVENTION

The invention relates to a device for splitting logs and more particularly relates to a log splitting device which derives its support and power from a tractor.

An object of the present invention is to provide a low cost, highly effective log splitting device which is supported by the power hitch of a tractor and connects to the hydraulic system of the tractor for power.

Another object of the present invention is to provide a new and improved log splitting device utilizing a two divergence angle wedge-shaped splitter member to improve the log splitting operation particularly when the logs are "green."

A further object of the present invention is to provide a new and improved log splitter that is supported as a contilever from the hydraulically-operated power hitch of a tractor to enable the log splitter to be positioned, for example, on the ground when splitting large logs and at convenient working height when splitting smaller logs.

The recent energy shortage has dramatically increased the demand for firewood and consequently increased the demand for powered log splitters. The present invnetion addresses such demand and provides a relatively inexpensive and mobile log splitter that can be mounted on the power hitch of a tractor. This arrangement eliminates the requirement for the splitter to be self-supporting and permits connection to the hydraulic system of the tractor thus eliminating the need for a self-contained power plant for the splitter.

The log splitter comprises an I-beam connected at one end to the power hitch of a tractor. A double-acting hydraulic ram connected to the hydraulic system of the tractor pushes a log past a double-divergent angle wedge for improved splitting of the log.

PREFERRED EMBODIMENT OF THE INVENTION

In the drawings:

FIG. 1 is an elevational view of the tractor-mounted log splitter according to the present invention and illustrating two vertical positions of adjustment of the splitter;

FIG. 3 is a sectional view taken substantially along the line 3—3 of FIG. 2; and FIG. 4 is a sectional view taken substantially along line 4—4 of FIG. 1.

Figure 2:
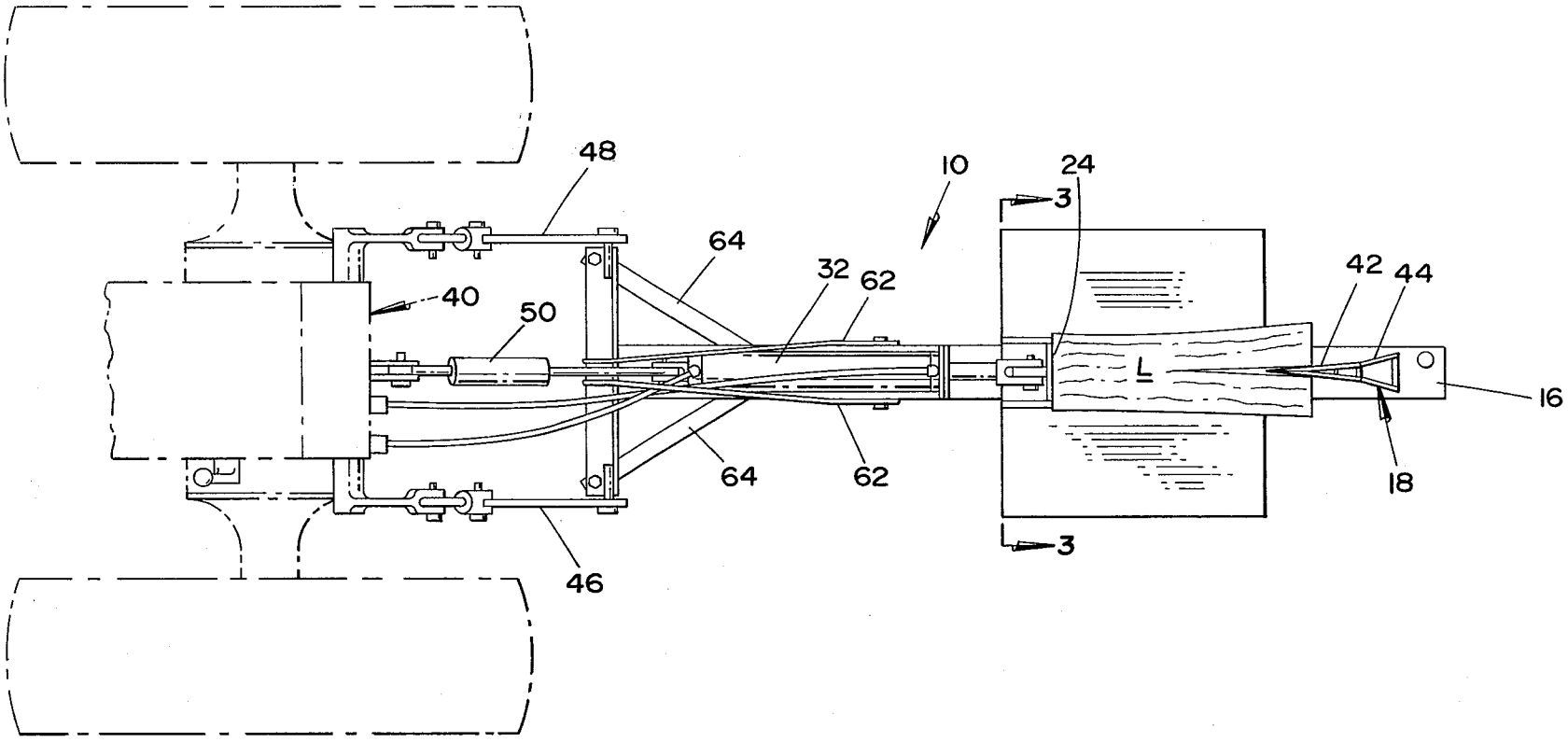
FIG. 2 is a plan view of the device of FIG. 1.

The preferred embodiment of the log splitter according to the present invention includes a log splitter indicated generally by the reference numeral 10. The log splitter 10 includes a support or base member 12 which may be constructed from I-beam 14.

The upper surface 16 of I-beam 14 supports log L to be split as illustrated in FIG. 1. Log L is advanced toward splitting means or wedge-shaped member 18 by a double-acting hydraulic ram means 20.

Ram means 20 includes a pusher plate 22 mounted for sliding movement along surface 16. Plate 22 bridges surface 16 and includes a vertically extending, log engaging surface 24, two depending skirt portions 26 having inwardly extending end portions 27 and a flange portion 29 for connection to the free end of piston rod 30. The plate 22 slides relative to I-beam 14 and skirts 26 and end portions 27 prevent lateral and vertical separation of the plate 22 from I-beam 14 during operation. Plate 22 is driven in opposite directions by piston rod 30. Piston rod 30 is driven by fluid in cylinder 32 in the usual manner.

Cylinder 32 is secured to one end of beam 14 in a suitable manner, as illustrated. Fluid is selectively delivered to each end of cylinder 32 by fluid hoses 34, 36. Hoses 34, 36 are connected at one of their ends to cylinder 32 and at their opposite ends to fluid outlet 38 of the hydraulic system 40 of tractor T.

Hydraulic system 40 represents a convential hydraulic system present on many tractors to power implements. Control lever means (not illustrated) control delivery of fluid to cylinder 32 to move ram 30 in opposite direction to drive log L into wedge 18 and to retract to permit loading of another log L on surface 16.

Wedge 18 improves the splitting action of logs by presenting two wedge portions 42, 44 (FIG. 2). Wedge portion 42 has a smaller angle of divergence than does wedge portion 44 as clearly shown in FIG. 2. Wedge portion 42 is more narrow to aid in the initial penetration of log L. After initial penetration, log L moves into contact with wedge portion 44 which causes a rapid separation of the log halves resulting, in most instances, in an immediate splitting of the entire log.

Such a wedge arrangement has been found to be of particular utility in splitting "green logs" and logs having long stringy fiber. The types of logs are difficult to split and the double-divergent wedge 18 affects rapid splitting of these logs. Obviously the wedge is also very effective in splitting the less difficult logs by accelerating the splitting time required per log.

Log splitter 10 is supported for vertical movement as a cantilever by tractor T. Tractor T has a commonly designated "three point hitch" comprising two power actuated links or arms 46, 48 and one adjustable length link or arm 50. Arms 46, 48, 50 are pivotally connected at one end to tractor T as illustrated. Note that powered arms 46, 48 are connected to and driven by fluid power system 40.

The other ends of arms 46, 48, 50 are pivotally connected to the apexes 52, 54, 56 (FIG. 4) of generally triangular-shaped connector means or frame 58 by removable connector pins 60. Frame 58 is suitably secured such as by bolts or welding to one end of beam 14 and is supported by vertical struts 62 and horizontal struts 64 as illustrated.

After log splitter 10 is connected to tractor T, link 50 is adjusted to orient frame 12 horizontal. Control lever 66 is moved to elevate frame 12 for transporting the log splitter to the work site and to adjust the working height of frame 12. Two positions of adjustment of frame 12 are illustrated in FIG. 1. The full line position illustrates the frame 12 resting on the ground where large diameter logs can be most conveniently loaded and split. When smaller diameter logs are to be split, frame 12 can be elevated to a convenient working height.

A pair of ramps 68 (FIG. 3) are provided as an aid in rolling heavy logs onto surface 16. The ramps 68 are suitably secured to the web of I-beam 14 such as by bolting as illustrated or by welding. Sufficient clearance is provided between skirts 26 and end portions 27 so that the ramps do not interfere with movement of the pusher plate 22. The ramps 68 also function as stabilizers for the frame 12 when resting on the ground.

What we claim is:

1. A log splitter adapted to be supported by and operated from a tractor comprising an I-beam providing a base member adapted to support a log to be split, a connector frame at one end of said base member to effect cantilevered support of said base member from a tractor, log abutment means slidably mounted on said base member adapted to engage one end of a log, a wedge-shaped member on said base in opposed relation to said abutment means and adapted to engage the opposite end of a log, drive means on said base having power transfer means connectable to a tractor power system and operatively connected to said abutment means for sliding said abutment means on said base member to thereby effect relative movement between said abutment means and said wedge-shaped member to force said wedge-shaped member through a log, and ramp means connected to the web of said I-beam and extending outwardly and downwardly therefrom to facilitate the rolling of a log onto said base member and to stabilize the base member when resting on the ground.

2. A log splitter as defined in claim 1 wherein said abutment means comprises a plate extending vertically from and slideable along said base member and reversible fluid operated ram supported on said base and connected to said plate.

3. A log splitter as defined in claim 2, wherein said plate further includes depending skirt portions terminating in inwardly extending end portions disposed beneath the upper flange of the I-beam on opposite sides of the web thereof for guiding the plate in movement along said base member.

4. A log splitter as defined in claim 1 wherein said connector frame includes three connection areas arranged at the apex of a triangle.

5. A log splitter as defined in claim 1, wherein said ramp means comprises a pair of plates secured to opposite sides of said web.

6. A log splitter as defined in claim 1, wherein said wedge-shaped member includes first and second portions arranged to successively engage the log, said second portion having an angle of divergence greater than the angle of divergence of said first portion.

* * * * *